US009981796B2

(12) United States Patent
Lichtenegger et al.

(10) Patent No.: US 9,981,796 B2
(45) Date of Patent: May 29, 2018

(54) PACKING POLYCRYSTALLINE SILICON

(71) Applicant: Wacker Chemie AG, Munich (DE)

(72) Inventors: Bruno Lichtenegger, Emmerting (DE); Reiner Pech, Neuoetting (DE); Matthias Vietz, Mattighofen (AT)

(73) Assignee: WACKER CHEMIE AG, Munich (DE)

( * ) Notice: Subject to any disclaimer, the term of this patent is extended or adjusted under 35 U.S.C. 154(b) by 247 days.

(21) Appl. No.: 14/905,712

(22) PCT Filed: Jun. 26, 2014

(86) PCT No.: PCT/EP2014/063481
§ 371 (c)(1),
(2) Date: Jan. 15, 2016

(87) PCT Pub. No.: WO2015/007490
PCT Pub. Date: Jan. 22, 2015

(65) Prior Publication Data

US 2016/0167862 A1 Jun. 16, 2016

(30) Foreign Application Priority Data

Jul. 18, 2013 (DE) ..... 10 2013 214 099

(51) Int. Cl.

| | |
|---|---|
| ***B65D 85/00*** | (2006.01) |
| ***B65D 81/05*** | (2006.01) |
| ***B65B 25/00*** | (2006.01) |
| ***B65B 29/00*** | (2006.01) |
| ***B65B 55/20*** | (2006.01) |
| ***B65B 5/06*** | (2006.01) |
| ***B65D 75/38*** | (2006.01) |
| ***B65D 81/127*** | (2006.01) |
| ***B65D 81/20*** | (2006.01) |

(Continued)

(52) U.S. Cl.
CPC ..... *B65D 81/051* (2013.01); *B65B 5/067* (2013.01); *B65B 25/00* (2013.01); *B65B 29/00* (2013.01); *B65B 55/20* (2013.01); *B65D 19/00* (2013.01); *B65D 75/38* (2013.01); *B65D 77/04* (2013.01); *B65D 81/127* (2013.01); *B65D 81/2023* (2013.01)

(58) Field of Classification Search
USPC ..... 206/524.1, 524.6, 527, 521, 499
See application file for complete search history.

(56) References Cited

U.S. PATENT DOCUMENTS

| | | | | |
|---|---|---|---|---|
| 3,113,671 A * | 12/1963 | Mooney | ..... | B65D 57/00 206/205 |
| 6,220,702 B1 | 4/2001 | Nakamura et al. | | |
| 2005/0034430 A1 | 2/2005 | Holzlwimmer et al. | | |

(Continued)

FOREIGN PATENT DOCUMENTS

| | | |
|---|---|---|
| DE | 10 2007 027 110 A1 | 12/2008 |
| DE | 10 2011 000 561 A1 | 8/2012 |

(Continued)

*Primary Examiner* — Jacob K Ackun
(74) *Attorney, Agent, or Firm* — Brooks Kushman P.C.

(57) ABSTRACT

Puncturing of plastic bags containing polysilicon chunks during transport thereof and reduction of fines generation are minimized by use of a transport vessel containing at least two plastic bags containing polysilicon chunks with a packing density of greater than or equal to 500 kg/m$^3$.

5 Claims, 1 Drawing Sheet

(51) Int. Cl.
*B65D 19/00* (2006.01)
*B65D 77/04* (2006.01)

(56) References Cited

U.S. PATENT DOCUMENTS

| | | | | |
|---|---|---|---|---|
| 2009/0056279 | A1 | 3/2009 | Sasaki | |
| 2010/0154357 | A1 | 6/2010 | Wochner et al. | |
| 2012/0198793 | A1 | 8/2012 | Vietz et al. | |
| 2013/0042582 | A1 | 2/2013 | Vietz et al. | |
| 2014/0130455 | A1* | 5/2014 | Lazarus | B65B 1/30 53/428 |
| 2014/0157729 | A1 | 6/2014 | Weinmann et al. | |
| 2017/0233174 | A1* | 8/2017 | Yoshimura | B65D 85/30 53/459 |

FOREIGN PATENT DOCUMENTS

| | | | |
|---|---|---|---|
| DE | 10 2011 003 875 | A1 | 8/2012 |
| EP | 1 334 907 | A1 | 8/2003 |
| EP | 2 559 620 | A2 | 2/2013 |
| JP | 6027632 | U1 | 4/1994 |
| JP | 2001058674 | A2 | 3/2001 |
| JP | 2006143552 | A | 6/2006 |
| JP | 2006256628 | A | 9/2006 |
| JP | 2008189354 | A2 | 8/2008 |
| JP | 2010036981 | A2 | 2/2010 |
| JP | 2010528955 | A | 8/2010 |
| JP | 2011057229 | A2 | 3/2011 |
| WO | 2006017602 | A1 | 2/2006 |

* cited by examiner

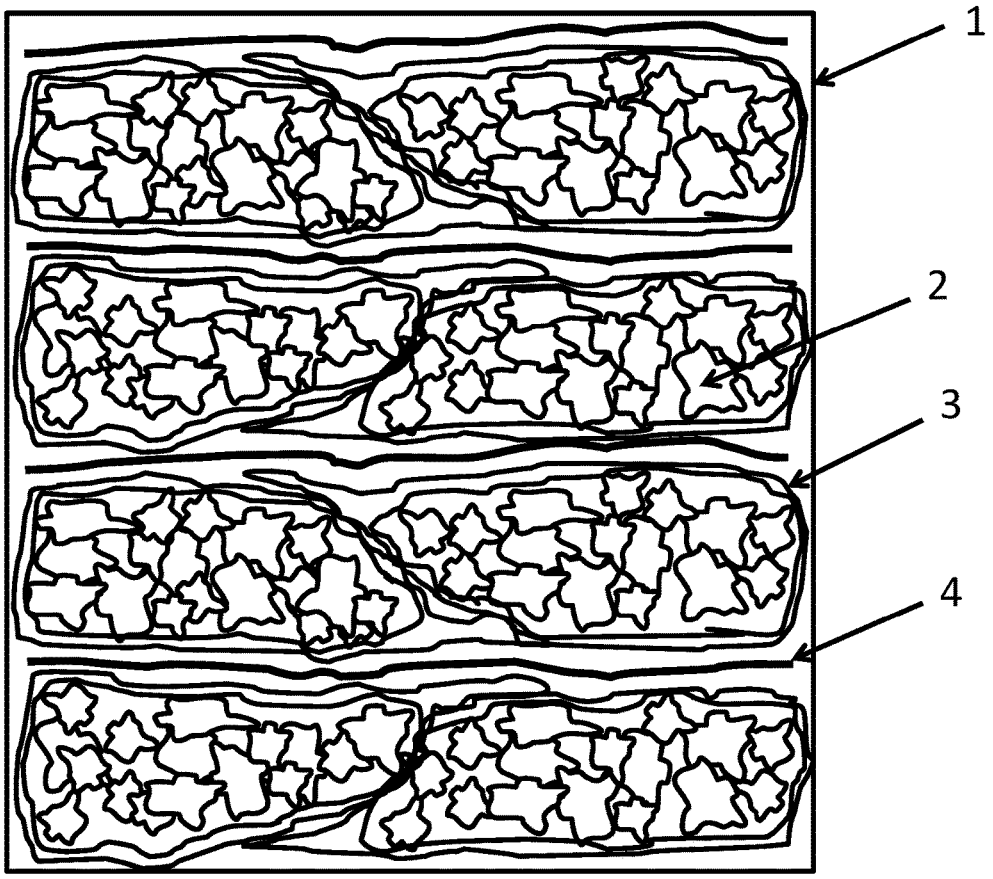
1
2
3
4

PACKING POLYCRYSTALLINE SILICON

CROSS REFERENCE TO RELATED APPLICATIONS

This application is the U.S. National Phase of PCT Appln. No. PCT/EP2014/063481 filed Jun. 26, 2014, which claims priority to German Application No. 10 2013 214 099.1 filed Jul. 18, 2013, the disclosures of which are incorporated in their entirety by reference herein.

BACKGROUND OF THE INVENTION

1. Field of the Invention

The invention relates to the packing of polycrystalline silicon.

2. Description of the Related Art

Polycrystalline silicon (polysilicon) is predominantly deposited by means of the Siemens process from halosilanes such as trichlorosilane and then comminuted with minimum contamination into polycrystalline silicon chunks.

For applications in the semiconductor and solar industries, chunk polysilicon with minimum contamination levels is desired. Therefore, the material should also be packaged with low contamination before being transported to the customer.

Typically, the polysilicon chunks are packed in single or multiple plastic bags. Usually, they are packed in double bags.

The bags are subsequently introduced into an outer package, for example a large cardboard box, and transported to the customer.

Chunk polysilicon is a sharp-edged bulk material which is sometimes not free-flowing. Therefore, in the packing operation, it has to be ensured that the material does not puncture the customary plastic bags in the course of filling, or even completely destroy them in the worst case.

In order to avoid this, various measures are proposed in the prior art.

US 20100154357 A1 proposes evacuating air out of the bag during the closure operation so as to result in a vacuum of 10 to 700 mbar.

US 20120198793 A1 discloses evacuating air out of the bag before the welding operation so as to result in a flat bag with a low air level.

However, it has been found that these measures are incapable of preventing punctures.

US 20100154357 A1 provides for an energy absorber within the plastic bag during the packing operation, which is supposed to prevent punctures.

Puncturing of the bag can occur, however, not just during the packing operation but also in the course of transport to the customer. Chunk polysilicon is sharp-edged, such that, in the event of unfavorable orientation of the chunks in the bag, relative movement of the chunks to the bag film and pressure of the chunks on the bag film result, respectively, in the chunks cutting through and penetrating the bag film. Chunks protruding from the bag packaging can be unacceptably contaminated directly by surrounding materials, and chunks inside by incoming ambient air.

In addition, in the course of transport of packed silicon chunks, there is unwanted post-comminution as a result of relative movement and collisions, or as a result of edge fracturing and abrasion. This is undesirable especially because the fines formed in the process demonstrably lead to poorer process performance with the customer. The result of this is that the customer has to screen off the fines fraction again prior to further processing, which is disadvantageous.

This problem applies equally to crushed and classified, cleaned and uncleaned silicon, irrespective of the size of package (typically bags containing 5 or 10 kg of polysilicon).

It has been found that the risk of damage to bags increases proportionally with the chunk mass.

One option which is conceivable in principle, that of reducing the puncture rate by reinforcing the bag film, has been found to be of low practicability, especially since such a less flexible film would be more difficult to handle and more expensive.

The main reason for these punctures and also post-comminutions lies in the excessive "freedom of movement" of the bags during transport. During transport (truck, air, sea and train, loading, etc.), there are a number of stresses on the packing unit.

Studies have shown that the most harmful influence here is to be found among the constant vibrations, as caused, for example, to a predominant degree by truck transport.

This problem gave rise to the objective of the invention.

SUMMARY OF THE INVENTION

The invention surprisingly minimized both the punctures and the fines formed during transport. At the same time, cost advantages were achieved. The inventors have recognized that the more space a packed polysilicon bag has in a secondary packing unit, for example a cardboard box, the more damaging the effect of vibrations. Excessively tight packing leads to an increased number of punctures; excessively loose packing can likewise lead to punctures and to considerably more fines. The invention therefore is directed to a controlled reduction in the room for movement (empty space) in the secondary packing unit (cardboard box), thus avoiding or considerably reducing unwanted post-comminution or puncturing of the packing film. By means of a controlled arrangement of the bags in the cardboard box, for instance through defined horizontal overlaying or by means of specific inserts, it is possible to avoid the fines/puncturing.

DETAILED DESCRIPTION OF THE DRAWINGS

FIG. 1 illustrates shipping of polysilicon chunks accurately to the invention.

DETAILED DESCRIPTION OF THE PREFERRED EMBODIMENTS

The inventive packing method applies equally to broken and classified, cleaned and uncleaned silicon in packages of 5 and 10 kg, or units in a similar order of magnitude. These are employed particularly in the case of chunk silicon having a typical edge length between 0.1 mm and 250 mm.

Further advantages include no bulging of the large box, constant box height compared to standard boxes, and reduction in production costs (lower costs for consumables and staff).

The invention thus relates to a transport vessel containing at least two plastic bags each with polycrystalline silicon chunks within, characterized by a packing density of greater than 500 kg/m$^3$.

The packing density in the context of the invention is defined as the starting weight of polycrystalline silicon chunks in relation to the internal volume of the transport vessel.

The packing density is preferably more than 650 kg/m$^3$. Particular preference is given to a packing density of greater than 800 kg/m$^3$. However, the packing density should be not more than 950 kg/m$^3$.

The invention also provides for securing of a plurality of transport vessels of the invention on a pallet.

The invention also relates to a method for transporting polycrystalline silicon chunks by means of a transport vessel of the invention, wherein the puncture rate of the plastic bags is less than 20% after the transport has ended. The puncture rate is preferably less than 10%, more preferably less than 5%. Ideally, no punctures at all occur.

Puncturing is defined in the context of the invention as a proportion of bags having at least one visible hole, i.e. a hole having a longitudinal extent of greater than or equal to 0.3 mm, in relation to all the bags in the transport vessel.

The fraction of Si fines formed during the transport is preferably <100 ppmw, more preferably <50 ppmw. Ideally, no fines are formed.

Hereinafter, for chunk sizes 3 to 5, all chunks or particles of silicon having such a size that they can be removed by means of a mesh screen having square meshes of size 8 mm×8 mm are to be referred to as fines. For chunk sizes 0 to 2, the same definition applies, except that mesh size is defined here as 1 mm×1 mm.

Size class is defined as the longest distance between two points on the surface of a silicon chunk (=max. length):

Chunk size (CS) 0 [mm] 0.1 to 5
Chunk size 1 [mm] 3 to 15
Chunk size 2 [mm] 10 to 40
Chunk size 3 [mm] 20 to 60
Chunk size 4 [mm] 45 to 120
Chunk size 5 [mm] 100 to 250

In each case, at least 90% by weight of the chunk fraction is within the size ranges mentioned.

Preferably, the residual volume present in the transport vessel (=box volume−volume of all the bags) is filled by specific inserts, for example foam, box inserts to an extent of greater than 70%, more preferably to an extent of 100%.

Preferably, shape-forming elements made of PU, polyester or expandable polystyrene or another polymer are also introduced.

It is preferable that the bags are arranged horizontally in the transport vessel. This is understood to mean that the filled bags lie with their longer side on the box base. A vertical arrangement would, in contrast, mean that the filled bags are placed upright into the box.

The bags may overlap in the case of a horizontal arrangement, meaning that a bag may also partly lie on top of another bag.

The preferred horizontal arrangement of the bags in the box is shown hereinafter by FIG. 1.

FIG. 1 shows a box with 8 filled bags.

REFERENCE NUMERALS

1 box
2 polysilicon chunks
3 bag
4 inserts

Eight bags 3, each filled with polysilicon chunks 2, have been introduced into box 1. A total of four planes with two bags 3 each are present. Inserts 4 have been introduced between some of the planes. The bags 3 have been arranged horizontally; the elongated side of the bags 3 is roughly parallel to the plane of the box base.

Dividers between the bags, such as inner boxes, cell dividers or dividers made of cardboard, are preferable but not absolutely necessary for reliable transport.

For example, 8 bags each containing 10 kg of polysilicon chunks may have been introduced horizontally into a transport vessel. In this case, the transport vessel has thus been filled with 80 kg of polysilicon.

The transport vessels are preferably secured on a pallet, more preferably lashed down. For example, it is possible to secure 6 transport vessels each containing 80 kg of polysilicon on one pallet.

The transport vessel is preferably an outer packaging element, for example a cardboard box.

The total volume of a plastic bag in relation to the volume of the chunks is preferably 2.4 to 3.0.

This is accomplished by, after introducing the chunks into the plastic bag, removing the air present therein before the closure of the plastic bag.

Preferably, the plastic bag is a double bag, comprising a first and a second plastic bag and polysilicon in the form of chunks within the first plastic bag, the first plastic bag having been inserted into the second plastic bag, and both plastic bags having been sealed, the total volume of the double bag in relation to the volume of the chunks being 2.4 to 3.0. Preferably, the total volume of the first bag in relation to the volume of the chunks is 2.0 to 2.7.

Preferably, the dimensions of the first bag are such that the polymer films are closely aligned with the silicon chunks. In this way, relative movements between the chunks can be avoided.

The plastic bags preferably consist of a high-purity polymer. This is preferably polyethylene (PE), polyethylene terephthalate (PET) or polypropylene (PP), or composite films. A composite film is a multilayer packaging film from which flexible packages are made. The individual film layers are typically extruded or laminated.

The plastic bag preferably has a thickness of 10 to 1000 μm, more preferably a thickness of 100 to 300 μm.

The plastic bags can be closed, for example, by means of welding, adhesive bonding, sewing or form-fitting. They are preferably closed by means of welding.

In order to determine the volume of the packed bag, it is immersed into a water bath. The water displaced corresponds to the total volume of the bag.

The volume of the silicon was determined via the weight of the silicon, using the constant density of ultrapure silicon (2.336 g/cm$^3$). Alternatively, the volume of the silicon could likewise be determined via the immersion method.

The air can be removed from a silicon-filled plastic bag by various methods:

manual pressing and subsequent welding
clamp or ram device and subsequent welding
suction device and subsequent welding
vacuum chamber and subsequent welding The ambient conditions in the course of packing are preferably a temperature of 18-25° C. The relative air humidity is preferably 30-70%. It has been found that formation of condensation water can be avoided in this way. Preferably, the packing additionally takes place in the environment of filtered air.

EXAMPLES

Determination of the Fines Fraction

To determine the fines fraction of chunk sizes 3 to 5, a mesh screen with 8 mm square meshes, or 1 mm square meshes for smaller chunk sizes, and vibration motors are used. The fines fraction screened off was quantified by gravimetric means.

Example 1

Transport simulation (worst case): typical stresses from transport vibrations on truck bed surface for 800 km, truck transport impacts 2 to 6 g (acceleration due to gravity), horizontal impacts on changeover of loading unit and transport overseas.

Table 1 shows an overview of the boxes examined.

In the test examples, the poly chunks are arranged in PE double bags (290 μm) in the box as follows:

TABLE 1

| | |
|---|---|
| Box 1 | 32 × 10 kg in 320 kg vertically with CS4; internal box dimensions 1139 × 699 × 595 mm; outer bag 620 × 410 mm and inner bag 510 × 340 mm |
| Box 2 | 6 × 5 kg in 30 kg box with CS4; internal box dimensions 540 × 350 × 270 mm; outer bag 620 × 410 mm and inner bag 510 × 340 mm |
| Box 3 | 32 × 10 kg in 320 kg box horizontally with CS4; internal box dimensions 1139 × 699 × 595 mm; outer bag 620 × 410 mm and inner bag 510 × 340 mm |
| Box 4 | 8 × 10 kg in 80 kg box horizontally with CS4; internal box dimensions 740 × 550 × 280 mm; outer bag 620 × 410 mm and inner bag 510 × 340 mm |
| Box 5 | 8 × 10 kg in 80 kg box horizontally with CS1; internal box dimensions 740 × 550 × 280 mm; outer bag 620 × 410 mm and inner bag 510 × 340 mm |

The total volume of each double plastic bag in relation to the volume of the chunks present therein was in the range of 2.4 to 3.0.

Table 2 shows packing density, fines and punctures for the five cartons examined. 960 kg were evaluated per test run. The puncture rate is based on punctures of the outer bag.

TABLE 2

| | Packing density in kg/m$^3$ | Fines in ppm | Puncturing |
|---|---|---|---|
| Box 1 | | | |
| Test run 1 | 675 | 150 | 19.79% |
| Test run 2 | 675 | 300 | 15.63% |
| Test run 3 | 675 | 200 | 18.75% |
| Test run 4 | 675 | 250 | 19.79% |
| Test run 5 | 675 | 250 | 18.75% |
| Box 2 | | | |
| Test run 1 | 588 | 250 | 19.79% |
| Test run 2 | 588 | 150 | 18.75% |
| Test run 3 | 588 | 50 | 12.50% |
| Test run 4 | 588 | 200 | 14.06% |
| Test run 5 | 588 | 250 | 16.67% |
| Box 3 | | | |
| Test run 1 | 675 | 50 | 14.58% |
| Test run 2 | 675 | 100 | 15.63% |
| Test run 3 | 675 | 50 | 12.50% |
| Test run 4 | 675 | 100 | 0.00% |
| Test run 5 | 675 | 0 | 6.25% |
| Box 4 | | | |
| Test run 1 | 702 | 0 | 0.00% |
| Test run 2 | 702 | 100 | 15.63% |
| Test run 3 | 702 | 50 | 13.54% |
| Test run 4 | 702 | 50 | 8.33% |
| Test run 5 | 702 | 0 | 6.25% |
| Box 5 | | | |
| Test run 1 | 702 | 0 | 4.17% |
| Test run 2 | 702 | 50 | 0.00% |
| Test run 3 | 702 | 100 | 6.25% |
| Test run 4 | 702 | 0 | 0.00% |
| Test run 5 | 702 | 50 | 4.17% |

Example 2

1000 km truck journey with loading and unloading

Here too, boxes 1-5 according to Table 1 were examined.

Table 3 shows packing density, fines and punctures for the five boxes examined. 960 kg were evaluated per test run.

If the packing density is less than 500 kg/m$^3$, more than 400 ppmw of fines arise in the course of transportation and the puncture rate is greater than 25%, irrespective of the bag arrangement in the container (horizontal/vertical).

TABLE 3

| | Packing density kg/m$^3$ | Fines in ppm | Puncturing |
|---|---|---|---|
| Box 1 | | | |
| Test run 1 | 675 | 350 | 15.63% |
| Test run 2 | 675 | 150 | 11.46% |
| Test run 3 | 675 | 150 | 9.38% |
| Test run 4 | 675 | 200 | 9.38% |
| Test run 5 | 675 | 250 | 14.58% |
| Box 2 | | | |
| Test run 1 | 588 | 250 | 10.42% |
| Test run 2 | 588 | 100 | 5.21% |
| Test run 3 | 588 | 150 | 7.29% |
| Test run 4 | 588 | 100 | 5.73% |
| Test run 5 | 588 | 200 | 8.85% |
| Box 3 | | | |
| Test run 1 | 675 | 50 | 4.17% |
| Test run 2 | 675 | 80 | 4.17% |
| Test run 3 | 675 | 0 | 5.21% |
| Test run 4 | 675 | 70 | 10.42% |
| Test run 5 | 675 | 0 | 0.00% |
| Box 4 | | | |
| Test run 1 | 702 | 0 | 2.08% |
| Test run 2 | 702 | 0 | 0.00% |
| Test run 3 | 702 | 50 | 10.42% |
| Test run 4 | 702 | 100 | 5.21% |
| Test run 5 | 702 | 0 | 6.25% |
| Box 5 | | | |
| Test run 1 | 702 | 50 | 2.08% |
| Test run 2 | 702 | 50 | 3.13% |
| Test run 3 | 702 | 0 | 2.08% |
| Test run 4 | 702 | 0 | 0.00% |
| Test run 5 | 702 | 0 | 0.00% |

The invention claimed is:

1. A transport vessel comprising at least two plastic bags each with polycrystalline silicon chunks within, the transport vessel having a base, and having a packing density of greater than or equal to 650 kg/m$^3$ and less than or equal to 950 kg/m$^3$, wherein the plastic bags in the transport are vessel arranged horizontally and overlaying such that an elongated side of the plastic bags is parallel to a plane of the transport vessel base, and wherein the ratio of the total volume of each plastic bag to the volume of chunks present therein is 2.4 to 3.0.

2. The transport vessel of claim 1, having a packing density of greater than 800 kg/m$^3$ and less than 950 kg/m$^3$.

3. The transport vessel of claim 1, wherein a residual volume present in the transport vessel is filled to an extent of more than 70% by inserts made of foam or shape-forming elements of polyurethane, polyester, or expandable polystyrene.

4. The transport vessel of claim 1, wherein the plastic bags at least partially overlap.

5. The transport vessel of claim 1, wherein inserts are located between overlaying plastic bags.

* * * * *